US005505185A

United States Patent [19]

Miller

[11] Patent Number: 5,505,185

[45] Date of Patent: Apr. 9, 1996

[54] SINGLE CAM COMPOUND BOW

[76] Inventor: Larry Miller, 1628 Treeside, Rochester, Mich. 48307

[21] Appl. No.: 372,238

[22] Filed: Jan. 13, 1995

[51] Int. Cl.[6] ..... F41B 5/10

[52] U.S. Cl. ..... 124/25.6; 124/900

[58] Field of Search ..... 124/23.1, 24.1, 124/25.6, 86, 88, 900

[56] References Cited

U.S. PATENT DOCUMENTS

| | | | |
|---|---|---|---|
| 3,486,495 | 12/1969 | Allen | 124/25.6 |
| 3,958,551 | 5/1976 | Ketchum | 124/25.6 |
| 3,987,777 | 10/1976 | Darlington | 124/25.6 |
| 4,060,066 | 11/1977 | Kudlacek | 124/25.6 |
| 4,079,723 | 3/1978 | Darlington | 124/25.6 |
| 4,103,667 | 8/1978 | Shepley | 124/25.6 |
| 4,203,412 | 5/1980 | Rickard | 124/88 X |
| 4,365,611 | 12/1982 | Nishioka | 124/25.6 |
| 4,461,267 | 7/1984 | Simonds et al. | 124/88 X |
| 4,512,326 | 4/1985 | Jarrett | 124/25.6 |
| 4,562,824 | 1/1986 | Jennings | 124/25.6 |
| 4,718,397 | 1/1988 | Remick | 124/25.6 |
| 5,368,006 | 11/1994 | McPherson | 124/25.6 |

*Primary Examiner*—Eric K. Nicholson
*Assistant Examiner*—John A. Ricci
*Attorney, Agent, or Firm*—Gifford, Krass, Groh, Sprinkle, Patmore, Anderson & Citkowski

[57] ABSTRACT

A single cam compound bow includes a lower pulley assembly, an upper pulley assembly and three cables. The lower pulley assembly has an end of all three cables attached thereto and includes a power cam portion. The upper pulley assembly has the other end of the first and third cables attached thereto, and the other end of the second cable is attached to the upper bow limb. The upper pulley assembly is configured so that the first cable is unwound therefrom at a rate which differs, and is initially lower than, the rate at which the third cable is wound onto the upper pulley assembly. The configuration of pulleys causes the nock point of the bow string to travel in a straight line.

11 Claims, 6 Drawing Sheets

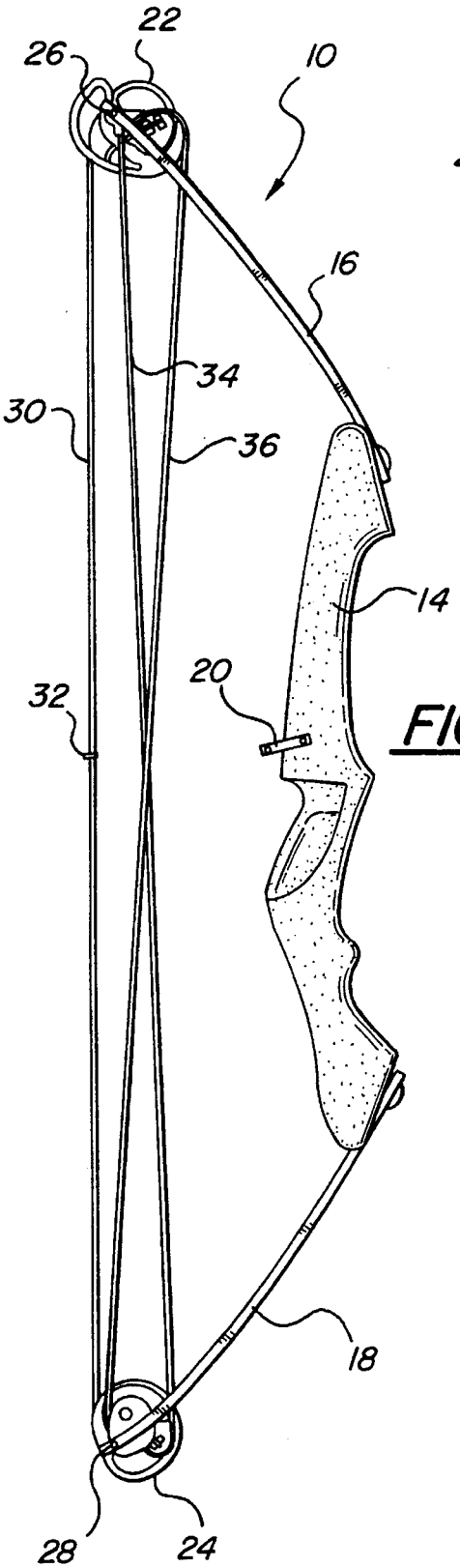
FIG-1
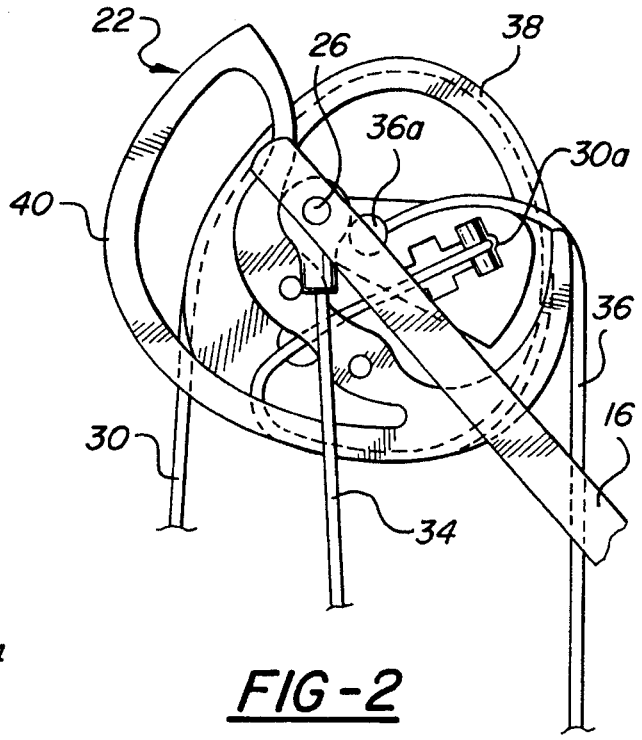
FIG-2
FIG-3
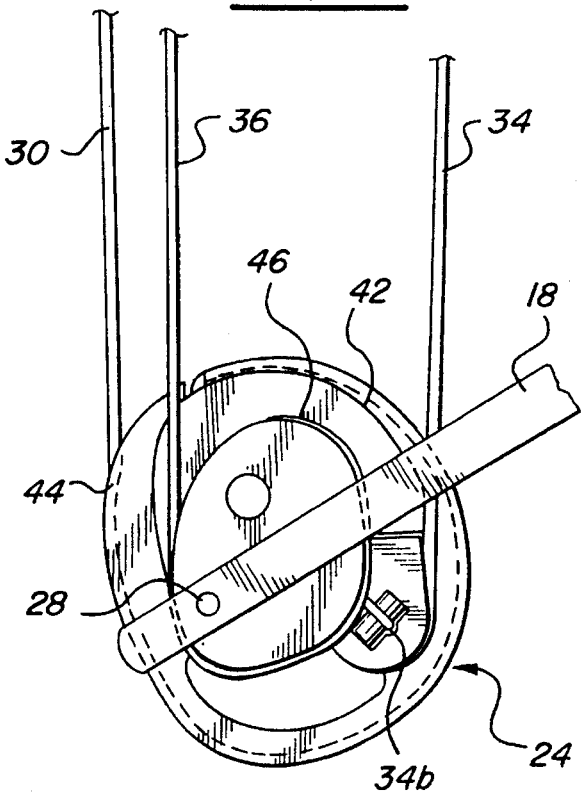

FIG-10
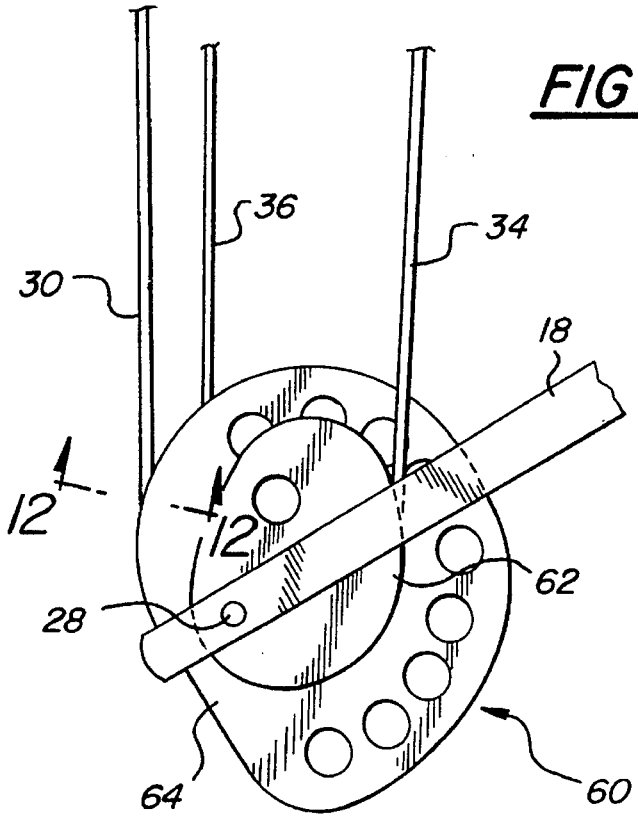
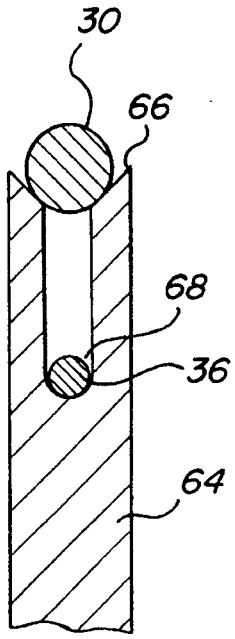
FIG-12
FIG-11
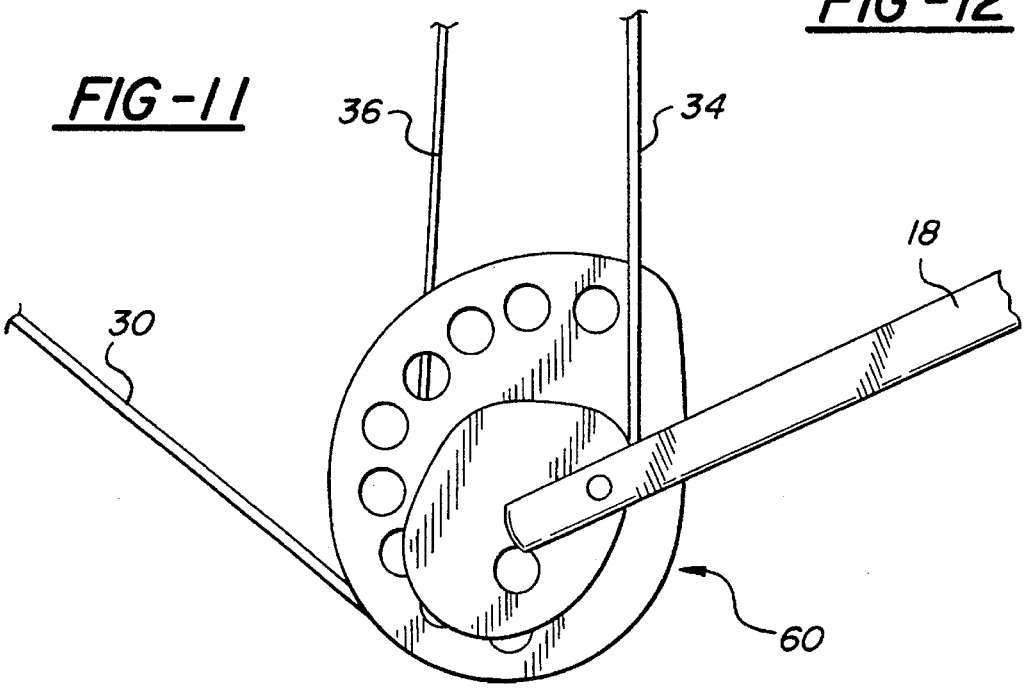

SINGLE CAM COMPOUND BOW

FIELD OF THE INVENTION

This invention relates generally to archery bows. More specifically, the invention relates to compound bows, and most specifically the invention relates to a single cam compound bow.

BACKGROUND OF THE INVENTION

In a compound archery bow, the force required to move the bow string (i.e. the draw force), varies as a function of the draw length. In a typical compound bow, the draw force is initially fairly high, and as the bow approaches a fully drawn condition, the draw force decreases. This let off in draw weight permits an archer to hold a fully drawn bow in a relatively steady position thereby providing an increase in accuracy. As a result of the let off and the force-draw characteristics of the bow the amount of energy that can be stored is maximized thereby providing for a flatter path of travel of the arrow, higher arrow velocity and an increase in the amount of energy delivered to the target. For these reasons, compound bows are widely used by target shooters and bow hunters.

In a typical compound bow, an arrangement of cams or levers, typically disposed at the limb tips of the bow, and operating through a series of cables, is employed to give a mechanical advantage as the bow is drawn and thereby modify the force draw curve. U.S. Pat. No. 3,486,495 describes a typical compound bow of the prior art, and many variations of this basic design are known. The bow of the U.S. Pat. No. 3,486,495, as well as most compound bows presently employed are what is termed dual cam bows because of the fact that a pair of cam elements are employed to control the force draw characteristics of the bow. While dual cam systems are widely employed, they suffer from problems because of the need to keep the two separate cams synchronized. If the cams are out of alignment they can produce an uneven and erratic bow string motion.

A bow string includes a nock point defined thereupon for engagement with the arrow, typically at a location at which the arrow is perpendicular to the string, when supported by an arrow rest associated with the handle portion of the bow. If the cams are out of alignment, the bow string will feed unevenly and the nock point will follow an erratic path when the bow string is drawn and released. This erratic path of travel can induce unwanted oscillations in the arrow, adversely affecting its accuracy. Also, misalignment of the cams will cause the draw characteristics of the bow, and the power delivered thereby to vary. As a result of these problems, some archers have avoided the use of compound bows despite their significant advantages.

In order to overcome the problems of cam alignment, the art has investigated bow designs in which power is delivered through only one cam. U.S. Pat. Nos. 4,365,611 and 5,368,006 disclose single cam bows in which a lower, eccentric pulley provides the camming action, and an upper, concentric pulley guides the motion of the bow string. It has been found that the performance of prior art, single cam bows is less than optimum because of the fact that the nock point of the bow string does not follow a linear path of travel. While this non-linear path of travel is relatively constant for a particular bow, it still adversely affects accuracy. Therefore, it will be appreciated that there is the need for a compound bow in which the nock point of the bow string maintains a linear path of travel. It is further desirable that the bow be capable of storing as large an amount of energy as possible, while providing a significant let off in draw weight at the fully drawn position. The present invention provides an improved single cam bow which incorporates a unique pulley design and in which the nock point of the bow string regularly, and repeatedly, travels along a linear path. These and other advantages of the present invention will be readily apparent from the drawings, discussion and description which follow.

BRIEF DESCRIPTION OF THE INVENTION

There is disclosed herein a compound archery bow which includes a handle having a first and a second flexible limb supported thereupon. The bow includes a top pulley assembly which is pivotably mounted to a first limb for rotation about an axle. The top pulley assembly includes a first groove and a second groove, and at least one groove defines a curve having a varying radius relative to the first axle. The bow also includes a bottom pulley assembly pivotably mounted upon a second limb for rotation about a second axle. The bottom pulley assembly includes a power cam portion which has a third groove defining a third curve having a varying radius relative to the second axle; the bottom pulley assembly also includes a bottom pulley element having a fourth groove, separate from the third groove, which defines a fourth curve having a varying radius relative to the second axle. The bow includes a first cable which has a first end thereof affixed to the top pulley assembly so that a portion of the length of that cable, proximate the first end, is received in said bottom pulley element. The first cable also includes a second end which is affixed to the bottom pulley assembly so that a portion of its length, proximate the second end, is received in the fourth groove. The first cable further includes a nock point defined thereupon at a point intermediate the first and second ends of the cable. The bow includes a second cable which has a first end thereof affixed to the first limb of the bow and a second end thereof which is affixed to the bottom pulley assembly. A portion of the length of the second cable, proximate the second end thereof is received in the third groove of the bottom pulley assembly.

The bow includes a third cable which has a first one of its ends affixed to the top pulley assembly so that a portion of the length of the third cable, proximate the first end, is received in the second groove. The third cable includes a second end which is affixed to the bottom pulley assembly so that a portion of its length, proximate the second end, is received in the bottom pulley element. The first and second grooves are configured so that when the top pulley assembly rotates about the first axle, the first cable is unwound from the first groove at a rate which differs from the rate at which the third cable is wound into the second groove. The third and the bottom element groove are configured so that when the bottom pulley assembly rotates about the second axle, the first and third cables are unwound from said bottom pulley element as the second cable is wound into the third groove. As a result of the foregoing relationship, the nock point moves in a straight line as the top and bottom pulley assemblies rotate in opposite directions.

In particular embodiments, the first and third cables may be received in the fourth groove in a side by side, or vertically stacked relationship. In another configuration, the bottom pulley element includes a fifth groove, and the first cable is received in the fourth groove and the third the third cable in the fifth groove. The fifth groove may be disclosed in a vertically stacked relationship with the fourth groove, and form a stepped structure, and the cables are of different diameters. In another embodiment, the first and third cables are a Y-shaped assembly in which two cables share a common second end and in which they share a mutually co-extensive segment extending from second end to a junction point. In this embodiment, a portion of the co-extensive segment is received in the fourth groove.

In yet another embodiment of the invention, the first and the second groove of the top pulley assembly are longitudinally aligned, and the first end of the first cable and the first end of the third cable are joined in an end to end relationship. In this embodiment, the top pulley assembly includes a notch defined therein, and the cog member is affixed to the first end of the first cable and the first end of the third cable. The cog member is configured to engage, and be retained by the notch so as to affix the first ends of the first and third cables to the top pulley assembly.

BRIEF DESCRIPTION OF THE DRAWINGS

FIG. 1 is a side elevational view of one embodiment of bow structured in accord with the present invention;

FIG. 2 is an enlarged depiction of the top pulley assembly of the bow of FIG. 1 as shown in an undrawn state;

FIG. 3 is an enlarged depiction of the bottom pulley assembly of the bow of FIG. 1 as shown in an undrawn state;

FIG. 10 is a depiction of another embodiment of bottom pulley assembly structured in accord with the principles of the present invention and shown in an undrawn state;

FIG. 11 is a depiction of the bottom pulley assembly of FIG. 10 as shown in a drawn state;

FIG. 12 is a cross-sectional view of a portion of the bottom pulley assembly of FIG. 10 taken along line 12—12;

DETAILED DESCRIPTION OF THE INVENTION

Figure 4:
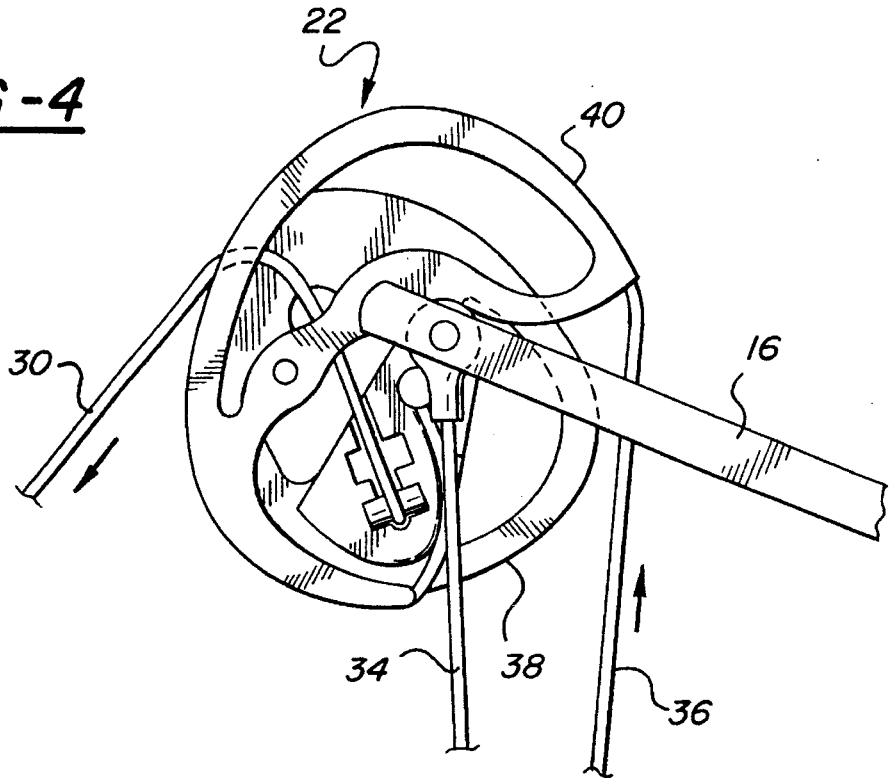
FIG. 4 is a depiction of the top pulley assembly of FIG. 2 as shown in a drawn state.

Referring now to FIG. 1, there is shown a side-elevational view of an archery bow 10 structured in accord with the principles of the present invention. The bow 10 includes a handle portion 14 having a first flexible limb 16 and a second flexible limb 18 supported thereupon. The handle portion 14 also includes an arrow rest 20 affixed thereto. The bow 10 of FIG. 1 includes a top pulley assembly 22, and a bottom pulley assembly 24 pivotably mounted to the limbs 16,18 for rotation about a first axle 26, and a second axle 28, respectively. The bow 10 further includes a first cable 30 having a first end thereof affixed to the top pulley assembly 22 and a second end thereof affixed to the bottom pulley assembly 24. The first cable 30 functions as a bow string, and toward that end includes a nock point 32 defined thereupon intermediate the first and second end. The nock point 32 typically comprises a crimped on metallic member disposed at a point on the first cable 30 at which an arrow, which has its nock engaged with the cable 30, and its shaft supported by the arrow rest 20, will be approximately perpendicular to the undrawn cable 30. The bow 10 further includes a second cable 34 having its first end affixed to the upper limb 16 and its second end affixed to the lower pulley assembly 24, and a third cable 36 which has its first end affixed to the top pulley assembly 22 and its second end affixed to the bottom pulley assembly 24.

In the bow of the present invention, as will be described in greater detail hereinbelow, the bottom pulley assembly is configured to provide a power cam which moderates the force draw curve of the bow to provide a let off at full draw and to enable storage of maximum energy therein. The bow of the present invention further includes a top pulley assembly which is configured to compensate for cable travel so as to cause the nock point of the bow string to travel in a linear path as the bow is drawn and released.

Referring now to FIG. 2, there is shown an enlarged view of the top pulley assembly 22 of the bow 10 of FIG. 1. As will be noted, the top pulley assembly 22 is pivotally mounted upon the bow limb 16 by an axle 26. The top pulley assembly 22 is configured to include a portion defining a first groove 38. The first cable 30 is disposed so that its first end **30*a* is affixed to the top pulley assembly, and a portion of its length, proximate its first end 30*a* as shown in phantom outline, is received in the first groove 38. The top pulley assembly further includes a second groove 40 defined therein. The third cable 36 has a first end 36*a* thereof affixed to the top pulley assembly and is disposed so that a portion of its length proximate the first end 36*a* is received in the second groove 40**.

As illustrated, the top pulley assembly 22 is configured so that the first groove 38 and second groove 40 each define a curve having a varying radius relative to the first axle 26. That is to say, the curves define a surface having a non-constant spacing from the axle. This is in contrast to the conventional pulley, such as that found in prior art single cam bows, in which the radius, as measured between the axle and curved surface is constant. In the depicted embodiment, the first 38, and second 40, grooves each define a curve of varying radius; however, the advantages of the present invention may also be obtained utilizing an upper pulley geometry in which only one of the curves is of varying radius. As will be explained in greater detail hereinbelow, the unique configuration of the top pulley assembly of the present invention controls the feed out and take up of the cables so as to assure that the nock point of the bow travels in a straight line.

FIG. 3 depicts the bottom pulley assembly 24 of the bow of FIG. 1. This pulley assembly 24 is supported upon the lower limb 18 of the bow by an axle 28. The bottom pulley assembly 24 includes a power cam portion having a third groove 42 defined thereupon. The second cable 34 has a second end **34*b* thereof retained by the cam portion of the lower pulley assembly 24, and a portion of its length proximate the second end 34*b* received and retained in the third groove 42. The third groove 42 defines a curve having a varying radius relative to the second axle 28**, and it is this varying radius which provides the camming action of the bow.

The bottom pulley assembly 24 further includes a bottom pulley element which can define either a fourth groove or a fourth and a fifth groove, and which engages the first 30 and third 36 cables. In the illustrated embodiment, the bottom pulley element defines fourth groove 44 which engages a portion of the length of the first cable 30, as is shown in phantom outline, and a fifth groove 46 which engages a portion of the length of the second end of the third cable 36. Although not visible in this drawing, the second ends of the first 30 and third 36 cables are fixedly attached to the bottom pulley assembly 24.

Figure 5:
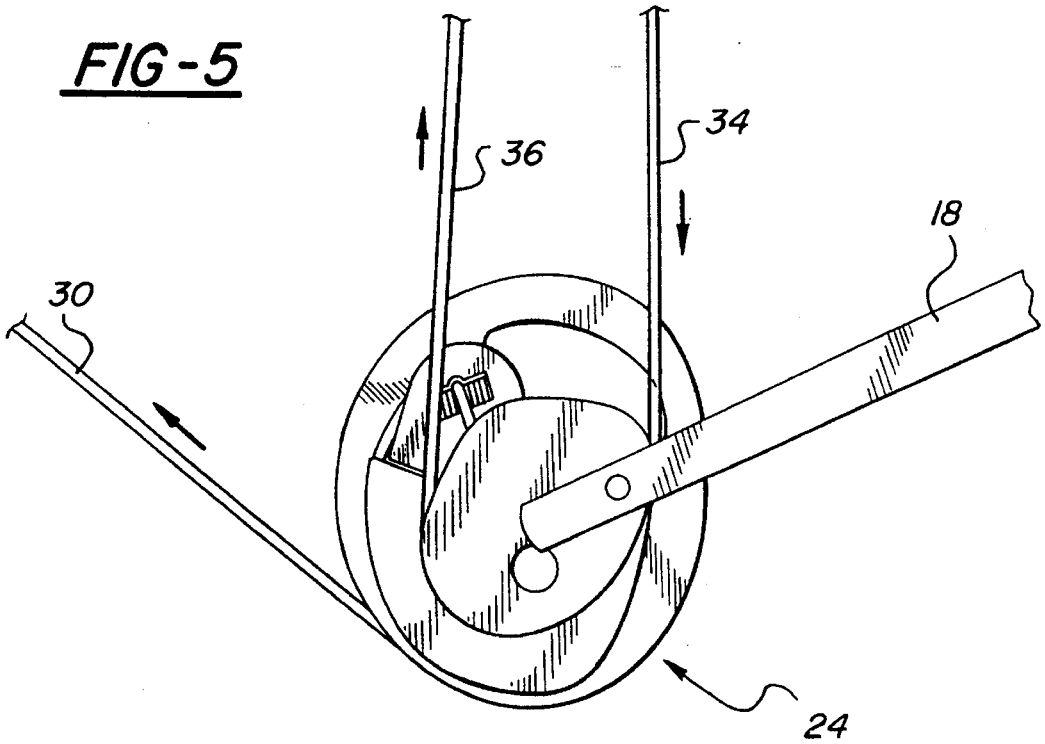
FIG. 5 is a depiction of the bottom pulley assembly of FIG. 3 as shown in a drawn state.

Referring now to FIGS. 4 and 5, there are shown the top pulley assembly 22 and bottom pulley assembly 24 of FIGS. 2 and 3 respectively as disposed when the bow is drawn. As shown in FIG. 4, the drawing of the bow unwinds a length of the first cable 30 from the first groove 38 of the upper pulley assembly 22, causing the assembly to rotate in a counter-clockwise direction. As the first cable 30 is unwound, the third cable 36 is wound into the second groove 40 of the top pulley assembly 22. The grooves of the top pulley assembly of the present invention are configured such that the rate at which the first cable 30 is unwound from the first groove 38 differs from the rate at which the third cable 36 is taken up by the second groove 40. It is this difference in feed rates which, at least in part, operates to control the path of travel of the nock point as the bow is drawn and released. In the illustrated embodiment of FIG. 4, the grooves are configured such that in the initial stage of draw of the bow, the rate at which the first cable 30 is fed out is less than the rate at which the third cable 36 is taken up. In addition to controlling nock point travel, this feature allows for a higher initial draw force, allowing more energy to be stored in the bow.

FIG. 5 is a corresponding depiction of the lower pulley assembly 24, and as shown, drawing of the bow unwinds the first 30 and the third, 36 cables from their respective grooves and causes the second cable 34 to be wound onto the power cam. Cable 34 is affixed to the top bow limb and this shortening of cable 34 occasioned by its winding up compresses the bow limbs, storing energy therein.

Figure 6:
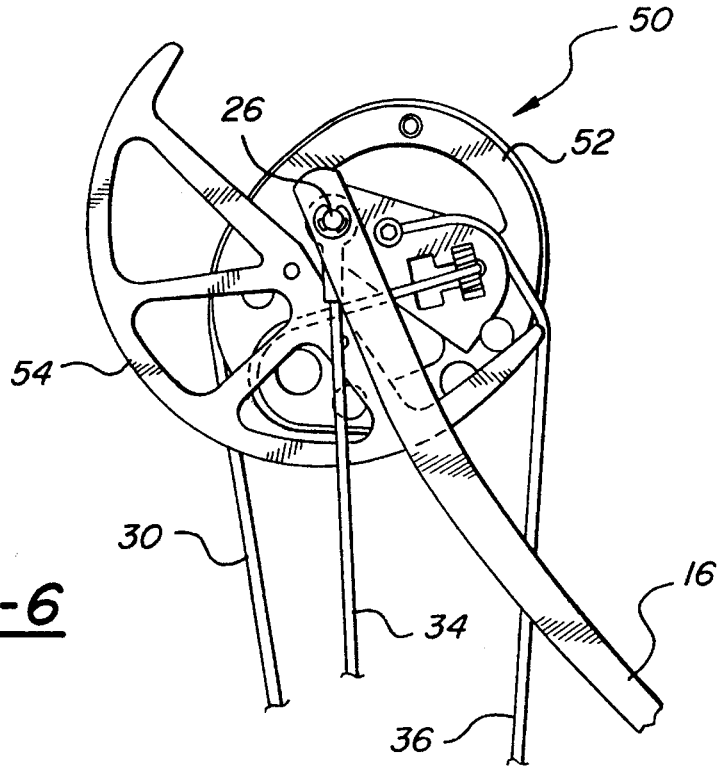
FIG. 6 is a depiction of another embodiment of top pulley assembly structured in accord with the principles of the present invention and shown in an undrawn state.

Other configurations of pulley assembly may be structured in accord with the principles of the present invention. FIGS. 6–9 depict an alternative configuration of top pulley assembly 50 and bottom pulley assembly 52 as shown in the drawn and undrawn state. In the FIG. 6 illustration, there is shown the top pulley assembly 50 as affixed to a limb 16 of a bow by an axle 26. The top pulley assembly includes a first groove 52 and a second groove 54 defined therein, and in this embodiment, both grooves have a varying radius relative to the axle 26. As in the previous embodiment, a portion of the first cable 30 is received in the first groove 52 and a portion of the third cable 36 is received in the second groove 54.

Figure 7:
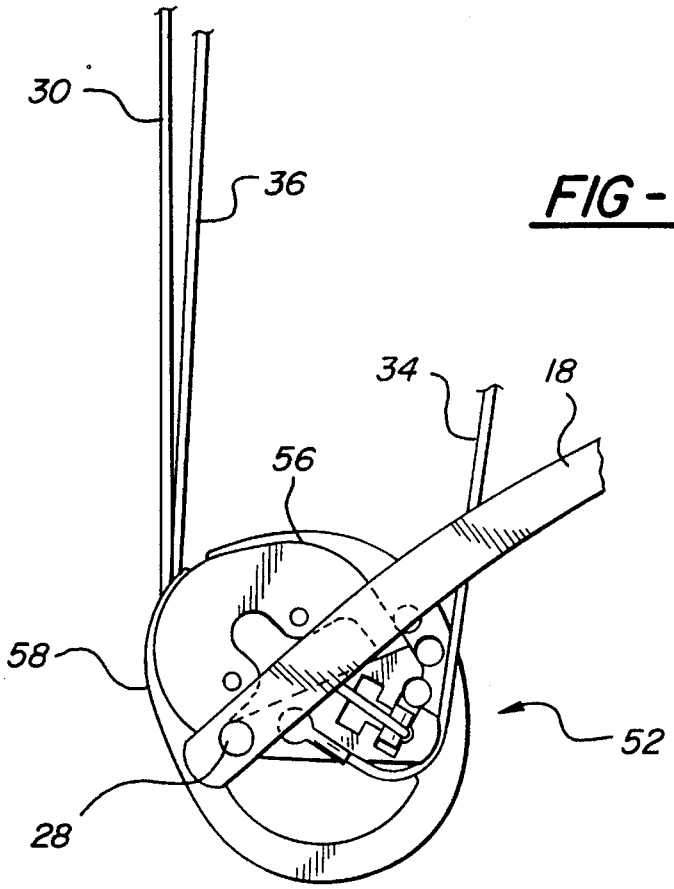
FIG. 7 is a depiction of another embodiment of bottom pulley assembly structured in accord with the principles of the present invention and shown in an undrawn state.

FIG. 7 depicts a lower pulley assembly 52 which includes a power cam portion having a third groove 56 defined thereupon. The third groove 56 has a varying radius relative to a second axle 28 and is configured to receive a portion of the length of the second cable 34, as the pulley assembly 52 rotates. The FIG. 7 pulley assembly 52 includes a single groove bottom pulley element 58 which receives the first 30 and second 36, cables in a stacked relationship.

Figure 8:
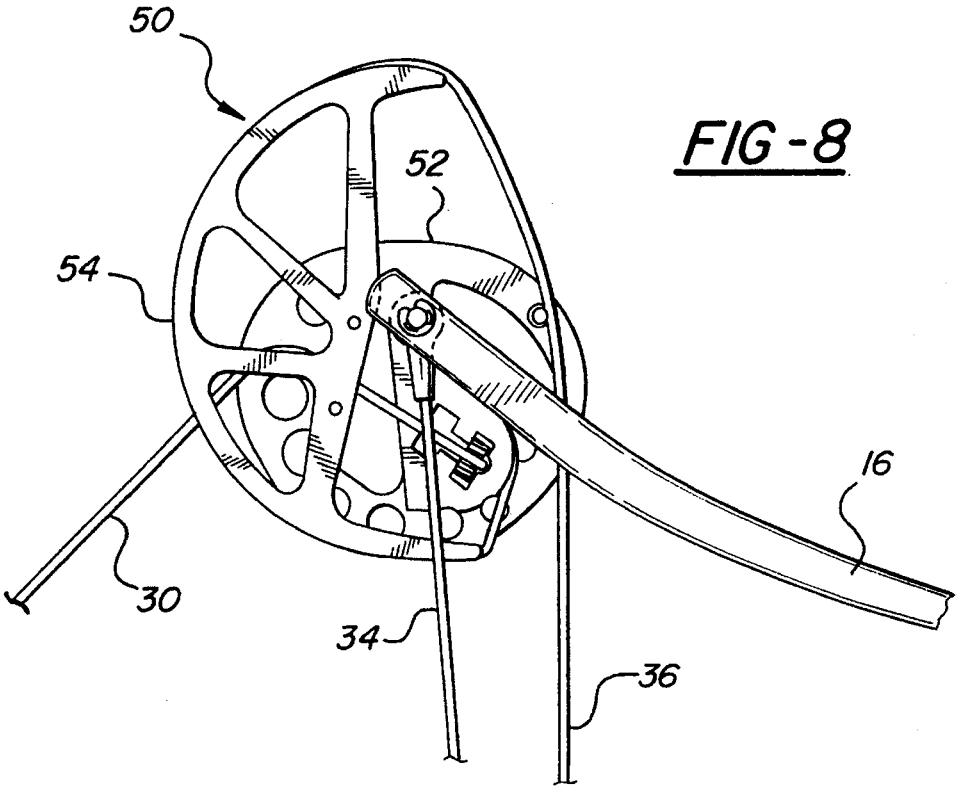
FIG. 8 is a depiction of the top pulley assembly of FIG. 6 as shown in a drawn state.
Figure 9:
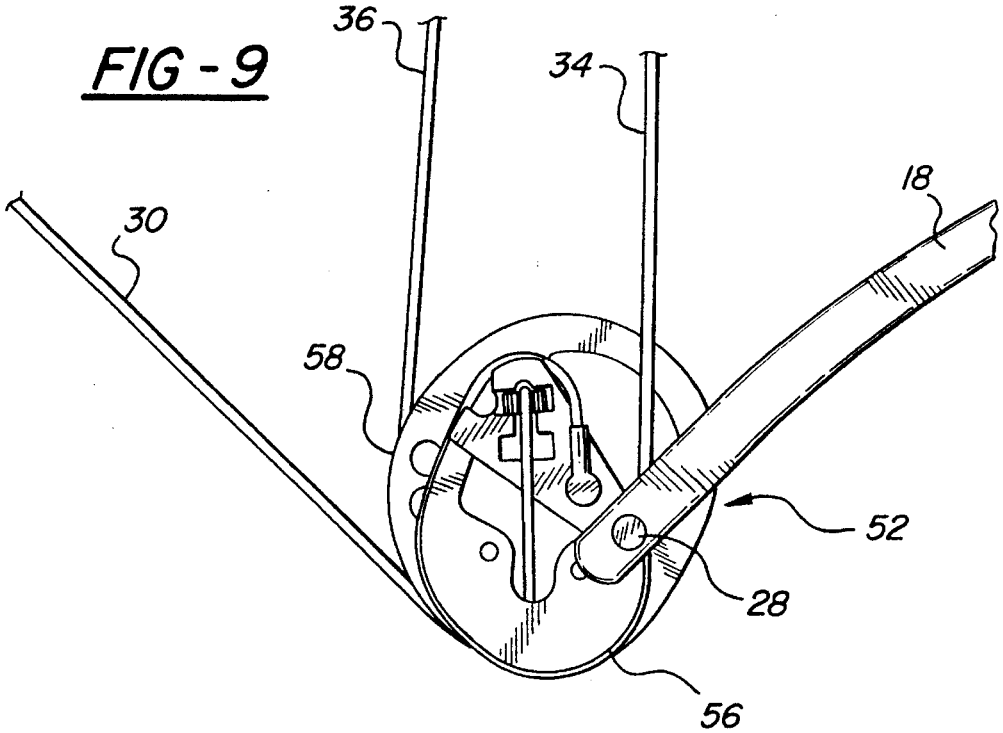
FIG. 9 is a depiction of the bottom pulley assembly of FIG. 7 as shown in a drawn state.

FIG. 8 depicts the upper assembly 50 of FIG. 6 in a drawn condition, and it will noted that the first cable 30 has been unwound from the first groove 52 while the third cable 36 has been wound into the second groove 54. As in the previous embodiment, the rate at which the first cable is unwound, and the second cable taken up differ. FIG. 9 depicts the lower pulley assembly 52 as the bow is drawn, and in this embodiment, the first 30 and third 36 cables are unwound from the fourth groove 58, which comprises the bottom pulley element, as the second cable 34 is taken up by the third groove 56 of the cam. In this embodiment, it will be noted that the first cable 30 and third cable 36 are fed out at approximately similar rates.

FIGS. 10–12 depict yet another configuration of bottom pulley assembly 60 structured in accord with the principles of the present invention. As shown in FIG. 10, a bottom pulley assembly 60 is affixed to a bow limb 18 by an axle 28. The bottom pulley assembly 60 includes a cam portion having a third groove 62 defined therein. As in previous embodiments, a portion of the second string 34 is received in the third groove 62. The pulley assembly 60 of FIG. 10 includes a bottom pulley element 64 having a fourth, 66 and fifth 68 groove defined therein in a stepped, vertically stacked relationship. FIG. 12 is a cross-sectional view of the bottom pulley element 64 of FIG. 10, and it better illustrates the fourth 66 and fifth, 68 grooves. It will be noted that the fifth groove 68 is of relatively narrow diameter, compared to the fourth groove 66. Also, the third cable 36 is smaller in diameter than the first cable 30. In this manner, the two cables 30,36 are spaced apart in a vertical stack. As discussed with reference to FIGS. 7 and 9 the first 30 and second 36 cables may be simply disposed in contact, in a stacked relationship in a single, relatively deep groove. FIG. 11 depicts the bottom pulley assembly 60 in a drawn position.

Figure 13:
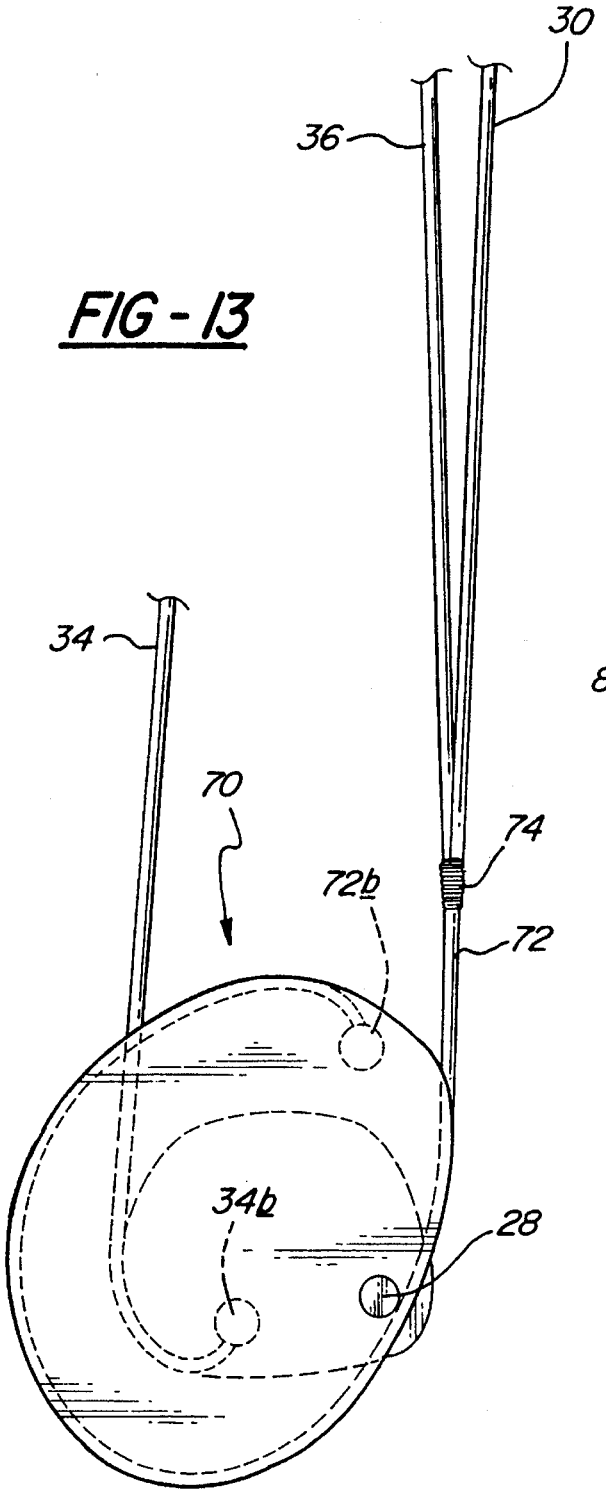
FIG. 13 is a depiction of another embodiment of cable and bottom pulley assembly structured in accord with the principles of the present invention.

Still other pulley and cable arrangements may be implemented in accord with the present invention. FIG. 13 depicts another bottom pulley assembly 70 which includes a cam portion having a third groove as previously described and configured to receive the second cable. The FIG. 13 embodiment includes a bottom pulley element having a fourth groove which receives a second end of both the first 30 and third, 36 cables, and is generally similar to the FIG. 7 embodiment; however, in the FIG. 12 embodiment, the first, 30 and third, 36 cables have a coextensive segment 72 extending from a junction portion 74 to a common second end **72*b*. In this embodiment, it is the coextensive segment 72 which is wound and unwound from the bottom pulley assembly 70**.

Figure 14:
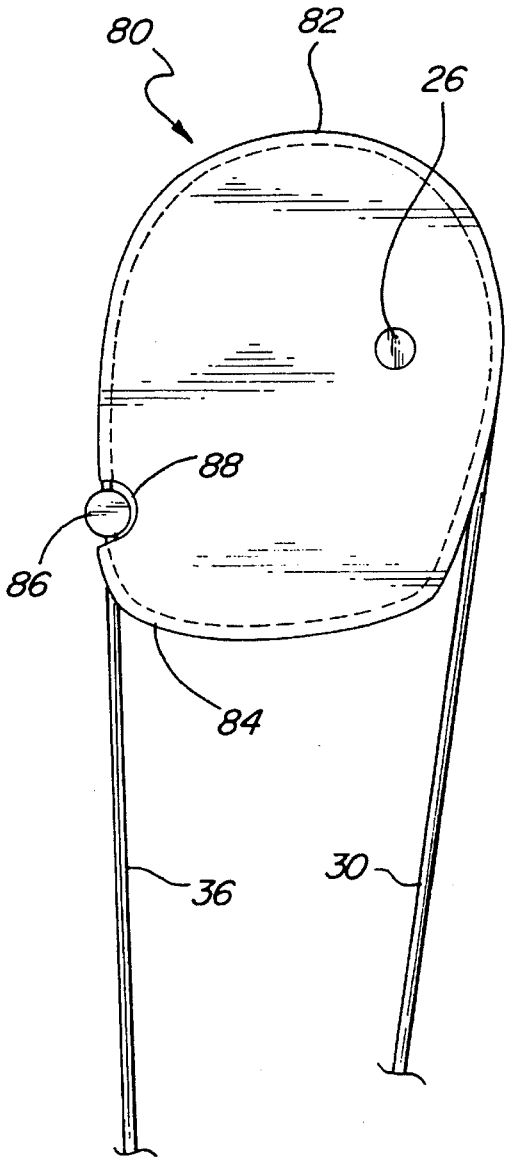
FIG. 14 is a depiction of another embodiment of top pulley assembly and associated cables, structured in accord with the principles of the present invention.

Referring now to FIG. 14, there is shown another embodiment of top pulley assembly 80, structured in accord with the principles of the present invention. The top pulley assembly 80 includes a first groove 82 and a second groove 84 which are disposed in longitudinal alignment. The FIG. 13 embodiment also includes a first cable 30 and a third cable 36 which are joined in an end to end alignment. The cables further includes a cog member 86 affixed thereto at the point where the two cables 30,36 are joined. The cog member 86 is typically formed as a bead or ball and has a diameter which is larger than the diameter of the cables. The upper pulley assembly 80 of the FIG. 14 embodiment further includes a notch 88 therein. This notch 88 is configured to engage the cog member 86 and serves to assure that the cables 30 and 36 remain properly aligned with their respective first groove 82 and second groove 84 as the pulley assembly 80 rotates. As in the previous embodiment, the configuration of the grooves 82 and 84 is such that they have a varying radius, and as a result, the rate at which the first cable 30 is fed out from the first groove 82, and the rate at which the third cable 36 is wound into the second groove 84 will differ.

It is to be understood that still other configurations of pulley assembly may be structured in accord with the present invention. Also, while various upper and lower pulley assemblies were described with reference one another, the various designs of pulley assemblies shown herein may be used in differing combinations. It is therefore, to be understood that the foregoing drawings, discussion and description are meant to be illustrative of the present invention and not meant to be limitations upon the practice thereof. It is the following claims, including all equivalents, which define the scope of the invention.

I claim:

1. An archery bow comprising:

a handle portion;

a first flexible limb supported by said handle portion;

a second flexible limb supported by said handle portion;

a top pulley assembly pivotably mounted upon said first limb for rotation about a first axle, said top pulley assembly including a first groove defining a first curve and a second groove defining a second curve, at least one of said first and second curves having a varying radius relative to said first axle;

a bottom pulley assembly pivotably mounted upon said second limb for rotation about a second axle, said bottom pulley assembly including a power cam portion having a third groove defining a third curve having a varying radius relative to said second axle and a bottom pulley element having a fourth groove separate from said third groove, said fourth groove defining a fourth curve having a varying radius relative to said second axle;

a first cable having a first end thereof affixed to said top pulley assembly and having a portion of the length thereof, proximate said first end, received in said first groove, said first cable having a second end thereof affixed to said bottom pulley assembly and having a portion of the length thereof, proximate said second end, received in said bottom pulley element, said first cable further including a nock point defined thereupon at a point intermediate said first and second ends;

a second cable having a first end thereof affixed to said first limb and a second end thereof affixed to said bottom pulley assembly and having a portion of the length thereof proximate said second end received in said third groove;

a third cable having a first end thereof affixed to said top pulley assembly and having a portion of the length thereof, proximate said first end, received in said second groove, said third cable having a second end thereof affixed to said bottom pulley assembly and having a portion of the length thereof proximate said second end received in said bottom pulley element;

wherein said first and second grooves are configured so that as said top pulley assembly rotates about said first axle, said first cable is unwound from said first groove at a rate which differs from a rate at which said third cable is wound into said second groove, and wherein said third groove and said bottom pulley element are configured so that as said bottom pulley assembly rotates about said second axle, said first and third cables are unwound from said bottom pulley element as said second cable is wound into said third groove; and wherein said nock point moves in a straight line as said top and bottom pulley assemblies rotate in opposite directions.

2. A bow as in claim 1, wherein said first and third cables are unwound from said bottom pulley element at the same rate and said rate differs from a rate at which said second cable is wound into said third groove.

3. A bow as in claim 1, wherein said first and third cables are received in said fourth groove in a side by side relationship.

4. A bow as in claim 1, wherein said first and third cables are received in said fourth groove in a vertically stacked relationship.

5. A bow as in claim 1, wherein said bottom pulley element further includes a fifth groove and said first cable is received in said fourth groove and said third cable is received in said fifth groove.

6. A bow as in claim 5, wherein said fourth groove and said fifth groove are disposed in a stepped relationship, and wherein said first cable has a diameter which is greater than a diameter of said third cable.

7. A bow as in claim 1, wherein said first and third cables share a common second end and have a coextensive segment extending from said second end to a junction point, and wherein a portion of said coextensive segment is received in said fourth groove.

8. A bow as in claim 1, wherein said first and second grooves are configured so that the rate at which said first cable is unwound from said first groove is less than the rate at which said third cable is wound into said second groove.

9. A bow as in claim 1, wherein said first and second grooves are configured so that when the bow is drawn from a rest position to a full draw position, a length of said third cable is wound into said second groove, said length being greater than a length of said first cable which is concomitantly unwound from said first groove.

10. An archery bow as in claim 1, wherein said first and said second groove are longitudinally aligned and wherein the first end of said first cable and the first end of said third cable are joined in an end to end relationship, said bow further including a notch defined in said top pulley assembly and a cog member affixed to the first end of said first cable and to the first end of said third cable, said cog member configured to engage, and be retained by, said notch so as to affix the first ends of said first and third cables to said top pulley assembly.

11. An archery bow comprising:

a handle portion;

a first flexible limb supported by said handle portion;

a second flexible limb supported by said handle portion;

a top pulley assembly pivotally mounted upon said first limb for rotation about a first axle, said top pulley assembly including a first groove defining a first curve having a varying radius relative to said first axle and a second groove, separate from said first groove, defining a second curve having a varying radius relative to said first axle;

a bottom pulley assembly mounted upon said second limb for rotation about a second axle, said bottom pulley assembly including a power cam portion having a third groove defining a third curve having a varying radius relative to second axle and a bottom pulley element having at least a fourth groove associated therewith, said fourth groove defining a fourth curve having a varying radius relative to said second axle;

a first cable having a first end thereof affixed to said top pulley assembly and having a portion of the length thereof, proximate said first end, received in said first groove, said first cable having a second end thereof affixed to said bottom pulley assembly and having a portion of the length thereof, proximate said second end, received in said bottom pulley element, said first cable further including a nock point defined thereupon at a point intermediate said first and second ends;

a second cable having a first end thereof affixed to said first limb and a second end thereof affixed to said bottom pulley assembly and having a portion of the length thereof proximate said second end received in said third groove;

a third cable having a first end thereof affixed to said top pulley assembly and having a portion of the length thereof, proximate said first end, received in said second groove, said third cable having a second end thereof affixed to said bottom pulley assembly and having a portion of the length thereof proximate said second end received in said bottom pulley element;

wherein said first and second grooves are configured so that as said top pulley assembly rotates about said first axle, said first cable is unwound from said first groove at a rate which differs from a rate at which said third cable is wound into said second groove, and wherein said third groove and said bottom pulley element are configured so that as said bottom pulley assembly rotates about said second axle, said first and third cables are unwound from said bottom pulley element as said second cable is wound into said third groove; and wherein said nock point moves in a straight line as said top and bottom pulleys rotate in opposite directions.

* * * * *